US005524368A

United States Patent [19]

Struck et al.

[11] Patent Number: 5,524,368

[45] Date of Patent: Jun. 11, 1996

[54] WIRELESS SNOW PLOW CONTROL SYSTEM

[75] Inventors: John M. Struck, Iron Ridge; Lynn W. Schultz, Campbellsport; Terry Wendorff, Cedarburg, all of Wis.

[73] Assignee: Sno-Way International, Inc., Hartford, Wis.

[21] Appl. No.: 203,545

[22] Filed: Mar. 1, 1994

[51] Int. Cl.[6] ..... E01H 5/04

[52] U.S. Cl. ..... 37/235; 37/414; 180/167

[58] Field of Search ..... 37/234, 907, 382, 37/235, 414, 231, 266, 236; 172/4, 4.5; 180/167

[56] References Cited

U.S. PATENT DOCUMENTS

| | | | |
|---|---|---|---|
| 2,674,052 | 4/1954 | Newkirk | 37/266 X |
| 2,858,625 | 11/1958 | Rivinius | 37/231 X |
| 3,069,983 | 12/1962 | Pizzarotti et al. | 37/907 X |
| 3,144,723 | 8/1964 | Carter | 37/414 |
| 3,934,654 | 1/1976 | Stephenson et al. | 37/266 X |
| 4,162,708 | 7/1979 | Johnson | 37/907 X |
| 4,164,821 | 8/1979 | Vanchot | 37/266 |
| 4,413,684 | 11/1983 | Duncklee | 37/907 X |
| 4,776,750 | 10/1988 | Griswold, Jr. et al. | 37/343 X |
| 4,991,323 | 2/1991 | Benkler | 37/235 |
| 4,999,935 | 3/1991 | Simi et al. | 37/236 |
| 5,174,385 | 12/1992 | Shinbo et al. | 37/907 X |
| 5,224,555 | 7/1993 | Bain et al. | 172/772.5 |

FOREIGN PATENT DOCUMENTS

| | | | |
|---|---|---|---|
| 59-76332 | 5/1984 | Japan | 414/699 |
| 216220 | 1/1990 | Japan | 364/424.07 |
| 649865 | 2/1994 | Japan | 37/414 |
| 665949 | 3/1994 | Japan | 37/414 |

*Primary Examiner*—Terry Lee Melius
*Assistant Examiner*—Victor Batson
*Attorney, Agent, or Firm*—Wheeler Kromholz & Manion

[57] ABSTRACT

A snow plowing system utilizing a wireless radio remote control to control a snow plow mounted to the front of a vehicle. The plowing system comprises a snow plow blade, mounting mechanism connected to the vehicle for mounting the snow plow blade to the vehicle, the snow plow blade being connected to the mounting mechanism, a transmitter for transmitting a signal through a receiver to actuate, a mechanism for controlling the snow plow blade, and the receiver being connected to the mechanism for controlling the snow plow blade.

4 Claims, 1 Drawing Sheet

WIRELESS SNOW PLOW CONTROL SYSTEM

Please place Disclosure Document No. 343,154 dated 19 Nov. 1993 in the file of this case.

BACKGROUND OF THE INVENTION

The present invention relates generally to snow plow controls for a snow plow of the kind designed to be connected to a vehicle like a car or a truck.

When a snow plow is installed, mounted, or connected to a vehicle, the installation typically requires that a control means, typically a series of switches, lights, and indicators, be mounted within the vehicle. Currently, the various movements and functions of snow plows are controlled by running wires from the lifting and pivoting means of the snow plow to a set of switches mounted within the vehicle cab. The switches at a minimum include a plow lifting and lowering switch and a plow left and right angling switch. Additional switches to control auxiliary plow functions are not uncommon. Electrical wiring must be run from the actuating means mounted on the plow or mounted on the vehicle which perform the various plow movements and functions to the control means mounted within the vehicle cab. The electrical wires must pass through the vehicle's front grill, engine compartment, fire wall, and dashboard in order to be connected to the switches mounted in the vehicle cab. Between the plow and the vehicle, the electrical wires must have a plug and receptacle so that the electrical wires can be disconnected when the plow is removed. Typically, the electrical wires passing through the vehicle and switches within the vehicle cab remain permanently mounted within the vehicle. The present invention eliminates the electrical wires, plug and receptacle, and permanent mounting of the switches by incorporating a wireless remote control.

Because of the amount of labor required to install the wiring and switches in a vehicle to which a snow plow is removably attached, they are typically left in place even when the plow is removed from the vehicle. There are many disadvantages to having permanently mounted plow controls.

First, it is necessary that the plow controls be mounted in a location easily accessible to the operator of the vehicle so that operator can operate the plow without having to reach far distances, move forward in the seat, take his or her eyes off of the road, etc. The result of this necessity is that the controls are often mounted where they can be in the way of the operator or interfere with access to other vehicle controls not used when plowing. This can cause inconvenience when not plowing and when there is no need for the controls to be mounted within the vehicle cab. Thus it is disadvantageous to have the plow controls remain mounted within the vehicle when the plow is not in use and it would be advantageous to be able to move the location of the controls when the vehicle is in use.

Second, the operator of the plow can only operate the plow when he or she is located within the vehicle cab. Often the operator finds it desirable to operate or move the snow plow when not in the vehicle. For example, when the operator makes height adjustments to the plow skids, which control the distance between the bottom edge of the plow (the mold board) and the pavement, it is more convenient for the operator to lower the plow from a remote location in front of the plow instead of constantly exiting and entering the vehicle cab to make the necessary adjustments.

Third, often times the same plow is used on a plurality of vehicles. In this situation, it is necessary to purchase and permanently mount many sets of snow plow controls for separately mounting in the cab of each vehicle. This practice can be expensive and labor consuming.

The inventor knows of no prior art that either teaches or discloses the unique features of the present invention.

SUMMARY OF THE INVENTION

The present invention comprises a wireless remote snow plow control to control a snow plow mounted to the front of a vehicle. The control consists of two principal components. A receiver, which is permanently mounted to the snow plow is connected to the lifting and pivoting means of the plow. A separate transmitter containing the requisite switches for controlling the plow functions can be located wherever the operator of the plow desires. This is typically somewhere within the vehicle cab, but permanent mounting is not required. Furthermore, when the plow is removed the transmitter can be kept with the stored plow because it is not necessary to permanently attach the transmitter to the vehicle. It is undesirable to permanently attach the transmitter to the vehicle. If the same plow is to be used on a separate vehicle, the operator of the separate vehicle need only obtain the transmitter that corresponds with the receiver permanently mounted to the particular snow plow. There is no need to permanently mount a second set of snow plow controls to the second vehicle.

When the operator actuates one of the switches on the transmitter, the transmitter sends a radio signal which is received by the receiver. An electrical signal is then sent from the receiver to the switching or actuating means of the snow plow. Because the transmitter is completely portable, the operator can operate the snow plow from any location provided he is within the transmitting range of the transmitter. Please note that the method of actuation of the controls on the transmitter need not be limited to physical activation but that any type of mechanism capable of activating the transmitter controls could potentially be used; e.g. a voice activated computer control. Therefore, the interpretation given the claims should be broad enough to include this possible alternative structure.

DETAILED DESCRIPTION

Figure 1:
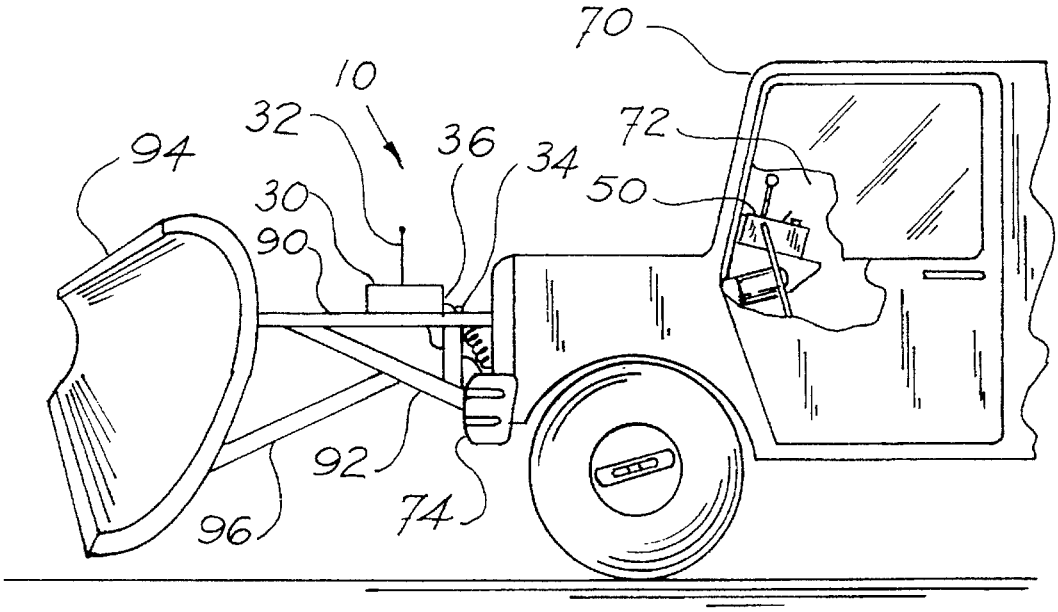
FIG. 1 is a side view of a vehicle having a snow plow mounted thereon utilizing the wireless snow plow controls of this invention.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention comprises wireless snow plow controls 10 for controlling the movement and functions of a snow plow 90 mounted to a vehicle 70, e.g. a car or truck. The wireless snow plow controls 10 include a transmitter 50 for transmitting radio signals and a receiver 30 for receiving radio signals. The transmitter 50 is portable and can be operated from any location provided it is still within a predetermined transmitting range with respect to the receiver 30. The receiver 30 is typically permanently mounted to the snow plow 90. The receiver 30 receives the radio signals transmitted by the transmitter 50 and then activates the various functions, such as lifting, lowering, angling right, angling left, etc., of the snow plow 90.

Referring to FIG. 1, a snow plow 90 may be seen to be connected to a vehicle 70. The plow 90 includes a plow blade 94 pivotally attached to the front of the plow mounting carriage 92. The mounting carriage 92 includes various known mechanisms 96 for lifting and pivoting the plow blade 94. Depending upon the design of the snow plow 90, some mechanisms 96 may be mounted on the front of the vehicle 74. These mechanisms 96 include hydraulic pumps, electric motors, hydraulic cylinders, levers, gears, pneumatic pumps, pneumatic cylinders, and other means for lifting, angling, and applying pressure to snow plow blades 94.

The other end of the plow mounting carriage 92 is connected to the front of the vehicle 74. The plow mounting carriage 92 is typically attached to the vehicle 70 in such a way that it is easily removed. Thus the entire plow 90, including control mechanisms 96, can be removed from the vehicle 70 when it is not necessary to use vehicle 70 for purposes of plowing snow.

Receiver 30 is typically mounted to plow mounting carriage 92 but could also be mounted anywhere on or within the vehicle 74. Receiver 30 includes an antenna 32 to aid in receiving the plow control radio signals sent by transmitter 50. Receiver 30 has an input wiring harness 34 which includes electrical wires for obtaining power from the vehicle 70 and an output wiring harness 36 for actuating solenoids and switches for the mechanisms 96 which function to raise, lower and pivot plow blade 94.

Transmitter 50 is a portable unit that can be located by the operator of the plow in any desirable location. This includes within the cab 72 of the vehicle 70 as shown in FIG. 1 or at a location outside of the vehicle cab 72. The only limitation regarding the location of transmitter 50 is that it must be located within a predetermined range of receiver 30 so that the signals transmitted can reach the receiver.

Figure 2:
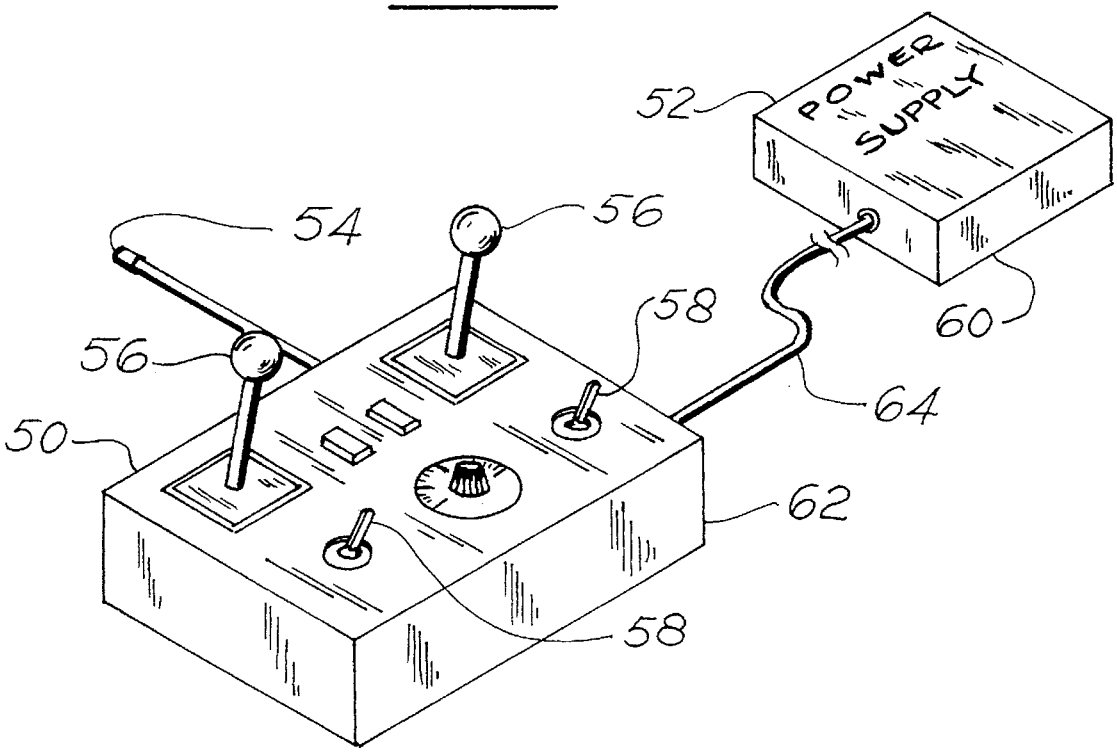
FIG. 2 is a perspective view of the snow plow control transmitter including an external battery pack.

As shown in FIG. 2, transmitter 50 requires a power supply 52. Power supply 52 can be a separate battery pack 60 as shown in FIG. 2, can be a battery pack located within housing 62 of transmitter 50, or transmitter 50 can obtain its power directly from the vehicle 70's power source. For example, power supply wires 64 could be adapted to be plugged into the cigarette lighter of vehicle 70.

Transmitter 50 includes an antenna 54, for purposes of aiding in the transmitting of plow control radio signals to receiver 30 and has a plurality of joystick switches 56 and toggle switches 58 for controlling the movements and positioning of plow 90. For safety reasons, it is important that transmitter 50 be easily accessible to the operator of the vehicle 70 and positioned in a convenient location so that the operator does not have to reach an excessive distance for the controls or take his or her eyes off the road when trying to locate the transmitter 50. Because transmitter 50 is completely portable, the operator can position the transmitter 50 in any desired location, including a location exterior to the vehicle cab 72. This is very convenient, especially when the operator needs to make adjustments to the plow 90 that require the plow 90 to be lifted or angled upon completion to ensure that the adjustments made are correct and do not cause any unforseen problems with the proper operation of the plow 90.

The transmitter 50 is of the type manufactured by Microtronics, Inc. of Humboldt, Kans. known as the MAX-1600 or MAX-3200 and generates an R.F. signal which is FM modulated. The modulation is a 120 bit data stream with start and step bits, information concerning the selected switch being activated and a specialized algorithm developed to ensure the validity of the transmission. Also transmitted are address information to enable the transmitter "talk" to its associated receiver. This address information is set so that no two devices will be the same. There may be no limit to the number of wireless snow plow controls 10 used in the same vicinity without any cross-activation.

The receiver 30, also of the type manufactured by Microtronics, Inc. of Humboldt, Kans., receives the radio signal transmitted by the transmitter 60, decodes the data stream and checks for validity of the address and the start and stop bits of the received data. If this is correct, a software algorithm is performed to accept or reject the information to be passed on to the receivers outputs 36. If for any reason this test fails, no output 36 will be sent from receiver 30. Once this test has passed, the appropriate output 36 will be sent. The output 36 activates one of the control mechanisms 96 mounted to the plow mounting carriage 92 for purposes of controlling the plow blade 94's position.

The transmitter 50 and receiver 30 operate on the 5 R.F. channels in accordance with FCC Subpart D—Lower Power Communications Devices, Part 15.117. Use of these devices is subject to the provisions of FCC Part 15.103. A license is not required to operate these devices. Finally, and alternatively, the transmitter 60 and receiver 30 may be designed to produce and receive any signal of the electromagnetic spectrum that would allow them to function in the manner described herein.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A wireless remote snow plow control system comprising:

a single vehicle;

a snow plow blade;

a mounting structure connecting the vehicle to the snow plow blade;

a transmitter mechanism for transmitting a wireless signal to a receiver mechanism within a transmitting range;

an adjusting mechanism for moving the snow plow blade;

the receiver mechanism being connected to the adjusting mechanism and the transmitter mechanism having at least one control for activating the adjusting mechanism through the receiver mechanism for adjusting the snow plow blade.

2. An improved snow plow system for use with a single vehicle having a snow plow mounted to the vehicle including a means for adjusting the snow plow mounted thereon, the improvement being a wireless snow plow control system comprising:

remote radio control including a transmitter for transmitting a radio signal to a receiver within a transmitting range;

the receiver being mounted to the snow plow system;

the receiver having an output connected to the means for adjusting the snow plow;

the transmitter transmitting radio signals to the receiver;

the receiver receiving the radio signals transmitted by the transmitter for adjusting the snow plow.

3. An improved apparatus for controlling the movement of a snow plow connected to a single vehicle without the use of electrical wires, the improvement being a wireless snow plow control system comprising:

a radio remote control transmitting means for transmitting a radio signal;

a radio remote control receiving means for receiving the radio signal;

the radio remote control receiving means being operatively connected to an adjusting mechanism for adjusting the snow plow;

the radio remote control transmitting means being located within a transmitting range of the radio remote control receiving means.

4. A method for using a wireless snow plow control system including a single vehicle, a snow plow blade, a mounting connecting the vehicle to the snow plow blade, a transmitter mechanism transmitting radio signals to a receiver, an adjusting mechanism for moving the snow plow blade, the receiver being connected to the adjusting mechanism and the transmitter mechanism having at least one control for activating the adjusting mechanism through the receiver, the method comprising:

activating the transmitter mechanism to send a signal to the receiver;

the receiver activating the adjusting mechanism for moving the snow plow blade.

* * * * *